US006361452B1

(12) United States Patent
Maruko et al.

(10) Patent No.: US 6,361,452 B1
(45) Date of Patent: Mar. 26, 2002

(54) THREAD-WOUND GOLF BALL

(75) Inventors: Takashi Maruko; Hisashi Yamagishi; Atsushi Nakamura, all of Saitama (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 09/517,450

(22) Filed: Mar. 2, 2000

(30) Foreign Application Priority Data

Mar. 3, 1999 (JP) ..... 11-055650

(51) Int. Cl.[7] ..... A63B 37/06; A63B 37/00

(52) U.S. Cl. ..... 473/357; 473/356; 473/362; 473/351

(58) Field of Search ..... 473/356, 357, 473/358, 359, 360, 361, 362, 363, 364, 366

(56) References Cited

U.S. PATENT DOCUMENTS 5,800,286 A * 9/1998 Kakiuchi et al. ..... 473/365
5,827,167 A * 10/1998 Dougan et al. ..... 473/356
6,030,296 A * 2/2000 Morgan et al. ..... 473/361
6,113,505 A * 9/2000 Boehm ..... 473/357
6,142,885 A * 11/2000 Umezawa et al. ..... 473/365

FOREIGN PATENT DOCUMENTS

| | | | |
|---|---|---|---|
| GB | 620208 | * | 3/1949 |
| JP | 57-160479 | | 10/1982 |
| JP | 57-170272 | | 10/1982 |

* cited by examiner

*Primary Examiner*—Paul T. Sewell
*Assistant Examiner*—Alvin A. Hunter, Jr.
(74) *Attorney, Agent, or Firm*—Sughrue Mion, PLLC

(57) ABSTRACT

In a thread-wound golf ball including a center ball, a thread layer, and a cover, the thread layer is formed of rubber thread and resin thread mixedly wound around the center ball. The resin thread wound around the center ball together with the rubber thread is preferably formed of a resin (such as polyester resin or polyurethane resin) which has relatively high resilience and is softer than rubber thread undergone extension crystallization.

8 Claims, No Drawings

THREAD-WOUND GOLF BALL

BACKGROUND OF THE INVENTION

1. Field of the Invention

The present invention relates to a thread-wound golf ball which has increased resilience, increased travel distance, and provides a favorable feel when hit.

2. Description of the Related Art

A thread-wound golf ball is manufactured in such a manner that rubber thread is wound around a center ball to form a thread layer, and a cover is formed to surround the thread layer. To increase the resilience of a thread-wound golf ball to thereby increase its travel distance, a technique for increasing the extendibility of rubber thread has conventionally been employed. This technique crystallizes rubber thread to a sufficient degree through extension (hereinafter this process is referred to as "extension crystallization"), thereby preventing further crystallization of the rubber thread which would otherwise occur when the ball deforms upon impact.

However, the technique for increasing the extendibility of rubber thread has the following drawback. Since the hardness of a thread-wound golf ball increases with the degree of extension crystallization of rubber thread, the degree of backspin becomes greater than that of a solid golf ball when the extendibility of the rubber thread exceeds a predetermined level. Thus, the travel distance of the thread-wound golf ball becomes shorter than that of the solid golf ball.

In view of the foregoing, the present inventors have carried out studies on the relationship between resilience of a thread-wound golf ball and the material of thread used in the thread layer thereof. The following four patent publications disclose conventional golf balls, each utilizing thread other than rubber thread to form a thread layer.

(1) JP Patent Laid-Open Publication No. 57(1982)-160479

In the golf ball disclosed in this publication, filament-like elastic fibers having an initial elastic modulus of at least 5 g/de and an elastic recovery ratio (50% extension) of at least 70% are used as thread for forming a thread layer. The filament-like elastic fibers are formed of polyolefine, polyacetal, polyamide, crystalline polypropylene, or polyoxymethylene.

(2) JP Patent Laid-Open Publication No. 57(1982)-170272

This publication discloses two types of thread-wound golf balls. In the first golf ball, filament-like elastic fibers formed of a thermoplastic polymer are used as thread for forming a thread layer. The cross-sectional area of each filament changes along the longitudinal direction at random intervals, and the intra-filament cross-sectional-area variation coefficient with respect to the longitudinal direction falls within a range of 0.05 to 1.0. The fibers have an initial elastic modulus of at least 5 g/de and an elastic recovery ratio (50% extension) of at least 70%.

In the second golf ball, a bundle consisting of a large number of filaments formed of a thermoplastic polymer is used as thread for forming a thread layer. The filament bundle has the following features. (1) In each filament constituting the bundle, the cross-sectional area changes along the longitudinal direction at random intervals. (2) The intra-filament cross-sectional-area variation coefficient with respect to the longitudinal direction falls within a range of 0.05 to 1.0. (3) The fibers have an initial elastic modulus of at least 5 g/de and an elastic recovery ratio (50% extension) of at least 70%. (4) The variation in cross-sectional area of filaments, as measured along an arbitrary plane perpendicular to the filament axis and expressed by use of an intra-bundle filament cross-sectional-area variation coefficient, falls within a range of 0.05 to 1.5.

(3) JP Patent Laid-Open Publication No. 10(1998)-247

This publication discloses a golf ball in which a thin wire formed of a shape memory alloy is used as thread for forming a thread layer.

(4) British Patent No. 620208

This patent discloses a golf ball in which a resin thread is used as thread for forming a thread layer. The resin thread has a property such that the resin is not oriented in an ordinary state, but is oriented when deformed. The resin thread is formed of vinylidene chloride or nylon.

The techniques employed in the golf balls disclosed in the above-described four patent publications are not necessarily satisfactory in terms of increasing resilience to thereby increase travel distance.

SUMMARY OF THE INVENTION

In view of the foregoing, an object of the present invention is to provide a thread-wound golf ball which has increased resilience, has increased travel distance, and provides a favorable feel when hit.

The present inventors found that the following advantageous effects are provided when rubber thread and resin thread are mixedly wound around a center ball, especially when the resin thread formed of a resin (such as polyester resin or polyurethane resin) which has relatively high resilience and is softer than rubber thread undergone extension crystallization is wound around the center ball together with the rubber thread.

(1) Resilience can be secured by means of sufficient extension of the rubber thread. In addition, since soft resin thread is co-present with the rubber thread, the golf ball does not lose softness. Therefore, the degree of backspin can be decreased, while high resilience is maintained, so that the golf ball provides a travel distance comparable to that of a solid golf ball.

(2) Since resin thread is co-present with rubber thread, the golf ball can provide softer hit-feel as compared with conventional thread-wound golf balls.

The present invention was accomplished on the basis of the above-described findings, and provides a thread-wound golf ball comprising a center ball, a thread layer, and a cover, wherein the thread layer is formed of rubber thread and resin thread mixedly wound around the center ball.

DESCRIPTION OF THE PREFERRED EMBODIMENT

The present invention will now be described in more detail. No limitation is imposed on the type of the center ball employed in the thread-wound golf ball of the present invention; the center ball may be a solid center ball obtained through molding a synthetic rubber into a spherical shape, or a liquid center ball formed of a spherical rubber bag filled with liquid. The center ball typically has an outer diameter of 26 to 36 mm. If necessary, the center ball may be formed to have a plurality of layers. When a solid center ball is employed, deformation of the solid center ball upon application of a load of 100 kg is preferably 3.5 to 10.0 mm.

The material of the resin thread preferably has a Shore D hardness of 15 to 50, more preferably 20 to 45, in order to yield a thread-wound golf ball providing a soft feel when hit.

The rubber thread preferably has a width of 1.0 to 2.5 mm and a thickness of 0.3 to 0.6 mm before winding. When the width is less than 1.0 mm or the thickness is less than 0.3, the strength of the rubber thread is insufficient, with the result that the rubber thread may frequently break upon winding. Thus, workability and quality may deteriorate. When the width is greater than 2.5 mm or the thickness is greater than 0.6, the sphericity of a spherical body obtained as a result of winding rubber thread and resin thread on the center ball is insufficient, so that the thickness of the cover becomes nonuniform, with the result that resilience lowers depending on the position of the golf ball at which the golf ball is hit.

The extendibility of the rubber thread upon winding is preferably set to a range of 700 to 1000%, more preferably 750 to 900%, in order to increase resilience of the golf ball to thereby increase travel distance.

The resin thread is preferably formed of a resin which has relatively high resilience and is softer than rubber thread undergone extension crystallization. Examples of the resin thread include, but are not limited to, resin thread containing polyester resin or polyurethane resin as a main component; specifically, resin thread containing, as a main component, polyester thermoplastic elastomer or polyurethane elastomer. More specific examples include Hytrel 3078, 4047, and 4767 (Shore D hardness: 47), which are polyester thermoplastic elastomers produced by Toray DuPont, and Pandex T-7890 and TR-3080, which are polyurethane elastomers produced by Dainippon Ink and Chemicals.

The material of the resin thread preferably has a Shore D hardness of 15 to 50, more preferably 20 to 45, in order to yield a thread-wound golf ball providing soft hit-feel.

The resin thread preferably has a flattened cross-section shape in order to facilitate thread winding. When the cross-section of the resin thread is close to circular, the resin thread tends to rotate upon winding, with the result that the resin thread tends to come loose. Therefore, the cross-sectional aspect ratio (thickness/width) of the resin thread is preferably set to 0.7 or less, more preferably 0.05 to 0.5.

The resin thread preferably has a width of 0.5 to 2.0 mm and a thickness of 0.05 to 0.4 mm before winding. When the width is less than 0.5 mm or the thickness is less than 0.05, the strength of the resin thread is insufficient, with the result that the resin thread may frequently break upon winding. Thus, workability and quality may deteriorate. When the width is greater than 2.0 mm or the thickness is greater than 0.4, the sphericity of a spherical body obtained a result of winding rubber thread and resin thread on the center ball is insufficient, so that the thickness of the cover becomes nonuniform, with the result that resilience lowers depending on the position of the golf ball at which the golf ball is hit.

The thread layer is preferably formed such that rubber thread(s) and resin thread(s) are simultaneously wound around the center ball. More preferably, a single rubber thread and a single resin thread are simultaneously wound around the center ball. In this case, a thread layer in which the rubber thread and the resin thread are mixedly present can be formed well.

The content ratio (weight ratio) between the rubber thread and the resin thread in the thread layer is preferably set to 9:1 to 3:7, more preferably, 9:1 to 5:5, in order to obtain both high resilience and soft hit-feel. Further, the thickness of the thread layer is preferably set to 1.0 to 7.0 mm. The content ratio between the rubber thread and the resin thread in the thread layer can be adjusted through adjustment of the cross-sectional dimensions and length of the resin thread.

No limitation is imposed on the method of winding the rubber thread and the resin thread onto the center ball, and an arbitrary method such as random winding (basket winding) or great-circle winding may be used.

No limitation is imposed on the material of the cover, and known cover materials may be used. Examples of the cover material include ionomer resin, polyurethane resin, polyester resin, and balata rubber. However, ionomer resin is preferred; more specifically, commercially available products such as Surlyn (product of DuPont) and Himilan (product of DuPont Mitsui Polychemicals) may be used. The cover material is formed to cover the thread layer, through ordinary injection molding or compression molding.

Numerous dimples are formed on the surface of the thus-obtained golf ball. If necessary, the surface of the golf ball is subjected to coating, stamping, and other finishing treatments. The golf ball has a hardness such that when a load of 100 kg is applied to the golf ball, the ball deforms in an amount of 2.6–4.0 mm, more preferably 2.8–3.8 mm. In compliance with the R&A golf rules, the golf ball is formed such that the golf ball has a diameter of 42.67 mm or greater and a weight of 45.93 g or less.

EXAMPLES

The present invention will be specifically described with reference to Examples and Comparative Examples. However, the present invention is not restricted to the Examples. All amounts shown in Table 1 represent parts by weight.

Examples

Each of the rubber compositions for solid centers A to D having the corresponding compositions shown in Table 1 was kneaded by use of a kneader, and vulcanized within a mold at 155° C. for about 15 minutes. Thus, the solid centers A to D were fabricated. Also, a rubber composition having the composition shown in Table 2 was formed into a sheet. After heating and vulcanization, the rubber sheet was cut into rubber threads.

TABLE 1

| Composition of core | A | B | C | D |
|---|---|---|---|---|
| 1,4-cis-Polybutadiene | 100 | 100 | 100 | 100 |
| Zinc acrylate | 20 | 25 | 20 | 27 |
| Zinc oxide | 10 | 10 | 10 | 10 |
| Antioxidant | 0.2 | 0.2 | 0.2 | 0.2 |
| Barium sulfate | 52.5 | 99.9 | 60.8 | 13.3 |
| Dicumyl peroxide | 1.2 | 1.2 | 1.2 | 1.2 |

TABLE 2

| Composition of rubber thread | Amount |
|---|---|
| Polyisoprene | 70.0 |
| Natural rubber | 30.0 |
| Zinc oxide | 1.5 |
| Magnesium stearate | 1.0 |
| Vulcanization accelerator + Sulfur | 2.6 |

Thread-wound golf balls of Examples 1 to 3 were each fabricated from one of solid centers A to B, the rubber thread having the composition shown in Table 2, one of resin threads E to G shown in Table 3, and the cover having the composition shown in Table 4. In the thread-winding step, a single rubber thread and a single resin thread were simultaneously would around the solid center. Subsequently, by means of injection molding, the thus-obtained thread layer was covered with the cover material having the composition shown in Table 4. Subsequently, ordinary coating was performed.

TABLE 3

| Resin thread | Product name |
|---|---|
| E | Hytrel 3078 |
| F | PANDEX T7890 |
| G | Hytrel 4047 |

Hytrel: product of Toray DuPont, polyester thermoplastic elastomer
PANDEX: product of Dainippon Ink and Chemicals, polyurethane elastomer

TABLE 4

| Cover | |
|---|---|
| Product name | Amount |
| Surlyn 8120 | 30 |
| Himilan 1557 | 50 |
| Himilan 1605 | 20 |

Surlyn: product of DuPont, ionomer resin
Himilan: product of DuPont Mitsui Polychemicals, ionomer resin Travel Performance Test By use of a swing robot, each golf ball was hit by a driver (W#1) having a loft of 11° at a head speed (HS) of 45 m/s, and spin, initial speed, carry travel distance, and total travel distance were measured. The driver used in the test was a Tour Stage X100 (product of Bridgestone Sport).

Hit-feel Test

The golf balls were subjected to sensory evaluation test for hit-feel in which three professional golfers hit the golf balls with a driver and evaluated hit-feel. Evaluation criteria for hit-feel are as follows:

○: Excellent

Δ: Good

×: Poor

TABLE 5

| | | Example 1 | Example 2 | Example 3 | Comparative Example 1 | Comparative Example 2 |
|---|---|---|---|---|---|---|
| Center | Composition | A | A | B | C | D |
| | Diameter (mm) | 31.8 | 31.8 | 28.7 | 31.8 | 38.7 |
| | Weight (g) | 23.0 | 23.0 | 19.6 | 23.7 | 35.5 |
| | Specific gravity | 1,366 | 1,366 | 1,583 | 1,408 | 1,170 |
| Thread layer | Diameter (mm) | 39.8 | 39.8 | 39.8 | 39.8 | — |
| | Weight (g)*1 | 35.6 | 35.5 | 35.5 | 35.5 | — |
| | Extendibility (%) | 900 | 900 | 1000 | 900 | — |
| | Resin thread | | | | | |
| | Type | E | F | G | — | — |
| | Shore D hardness | 30 | 40 | 40 | — | — |
| | Width (mm) | 1.50 | 1.00 | 1.50 | — | — |
| | Thickness (mm) | 0.20 | 0.40 | 0.20 | — | — |
| | Aspect ratio | 0.13 | 0.40 | 0.13 | — | — |
| Resultant golf ball | Diameter (mm) | 42.7 | 42.7 | 42.7 | 42.7 | 42.7 |
| | Weight (g) | 45.4 | 45.3 | 45.3 | 45.3 | 45.3 |
| Travel performance test HS: 45 m/s | Spin (rpm) | 2710 | 2820 | 2580 | 3100 | 2670 |
| | Initial speed (m/s) | 63.7 | 63.7 | 63.6 | 63.5 | 63.5 |
| | Carry (m) | 203.8 | 203.4 | 203.0 | 198.8 | 202.8 |
| | Total (m) | 222.7 | 221.8 | 222.8 | 215.4 | 222.0 |
| Hit-feel test | | ○ | ○ | ○ | Δ | X |

*1: Center + thread layer

The rubber thread having the composition shown in Table 2 was wound around the solid center C, and by means of injection molding the thus-formed thread layered was covered with the cover material having the composition shown in Table 4. Subsequently, ordinary coating was performed to complete a thread-wound golf ball (of a conventional type) of Comparative Example 1. Further, by means of injection molding the solid center D was covered with the cover material having the composition shown in Table 4, and ordinary coating was performed to complete a solid two-piece golf ball of Comparative Example 2.

Subsequently, the thus-obtained golf balls were evaluated in terms of travel distance and hit-feel, in accordance with the method described below. The properties of the respective golf balls and test results are shown in Table 5.

What is claimed is:

1. A thread-wound golf ball comprising a center ball, a thread layer, and a cover, wherein the thread layer is formed of rubber thread and resin thread mixedly wound around the center ball, the thread layer is formed through simultaneous winding of the rubber thread and the resin thread around the center ball and the extendibility of the rubber thread upon winding is 700–1000%.

2. A thread-wound golf ball according to claim 1, wherein the main component of the resin thread is polyester resin or polyurethane resin.

3. A thread-wound golf ball according to claim 1, wherein the cross-sectional aspect ratio (thickness/width) of the resin thread is 0.7 or less.

4. A thread-wound golf ball according to claim 1, wherein the material of the resin thread has a Shore D hardness of 15 to 50.

5. A thread-wound golf ball according to claim 1, wherein the resin thread has a width of 0.5 to 2.0 mm and a thickness of 0.05 to 0.4 mm before winding.

6. A thread-wound golf ball according to claim 1, wherein the rubber thread has a width of 1.0 to 2.5 mm and a thickness of 0.3 to 0.6 mm before winding.

7. A thread-wound golf ball according to claim 1, wherein the content ratio (weight ratio) between the rubber thread and the resin thread in the thread layer is 9:1 to 3:7.

8. A thread-wound golf ball according to claim 1, wherein the thickness of the thread layer is 1.0 to 7.0 mm.

* * * * *